US009657470B1

(12) United States Patent
Butterfield

(10) Patent No.: US 9,657,470 B1
(45) Date of Patent: May 23, 2017

(54) DUAL FLUSH TOILET FLAPPER VALVE SYSTEM

(71) Applicant: Bill Butterfield, Raymond, CA (US)

(72) Inventor: Bill Butterfield, Raymond, CA (US)

( * ) Notice: Subject to any disclaimer, the term of this patent is extended or adjusted under 35 U.S.C. 154(b) by 0 days.

(21) Appl. No.: 14/960,372

(22) Filed: Dec. 5, 2015

Related U.S. Application Data

(60) Provisional application No. 62/089,201, filed on Dec. 8, 2014, provisional application No. 62/137,529, filed on Mar. 24, 2015.

(51) Int. Cl.
*E03D 1/14* (2006.01)
*E03D 1/30* (2006.01)
*E03D 1/35* (2006.01)

(52) U.S. Cl.
CPC ..... *E03D 1/142* (2013.01); *E03D 1/308* (2013.01); *E03D 1/35* (2013.01)

(58) Field of Classification Search
CPC ..... E03D 1/142; E03D 1/308; E03D 1/35
USPC ..... 4/325
See application file for complete search history.

(56) References Cited

U.S. PATENT DOCUMENTS

| | | | |
|---|---|---|---|
| 3,935,598 | A | 2/1976 | Schmidt |
| 3,955,218 | A | 5/1976 | Ramsey |
| 4,000,526 | A | 1/1977 | Biela et al. |
| 4,115,880 | A | 9/1978 | Gruenhagen |
| 4,145,774 | A | 3/1979 | Sullivan |
| 4,907,302 | A | 3/1990 | Schoepe et al. |
| 4,945,580 | A | 8/1990 | Schmitt et al. |
| 5,004,462 | A | 4/1991 | Mahler |
| 5,090,066 | A | 2/1992 | Schoepe et al. |
| 5,157,796 | A | 10/1992 | Boyer et al. |
| 5,173,971 | A | 12/1992 | Schoepe et al. |
| 5,181,282 | A | 1/1993 | Comparetti |
| 5,228,144 | A | 7/1993 | Kightlinger |
| 5,259,074 | A | 11/1993 | Battle |
| 5,293,650 | A | 3/1994 | Schoepe et al. |
| 5,966,749 | A | 10/1999 | Goesling et al. |
| 6,571,401 | B2 | 6/2003 | Comparetti |
| 8,122,526 | B2 | 2/2012 | Li |
| 2004/0237182 | A1 | 12/2004 | Shih |
| 2014/0059756 | A1 | 3/2014 | Guthrie |

FOREIGN PATENT DOCUMENTS

ZA WO0248472 6/2002

*Primary Examiner* — Tuan N Nguyen
(74) *Attorney, Agent, or Firm* — William Keyworth; Bill & Mary Lou Inc.

(57) ABSTRACT

A toilet flapper valve dual flush system provides a choice of flush durations using flapper valve with a vented buoyancy chamber and an operating system that lifts the flapper valve from a vented side, rather than the center, to provide a simple effective control of the volume of water used.

15 Claims, 10 Drawing Sheets

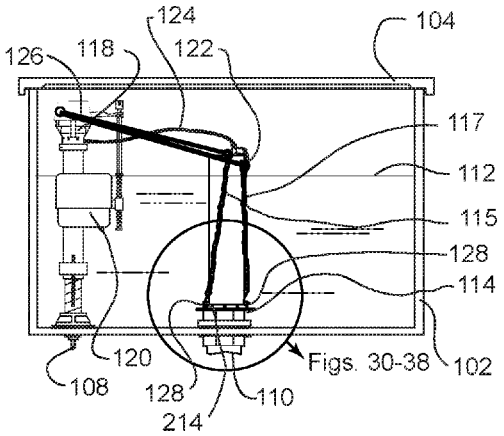
Fig. 29
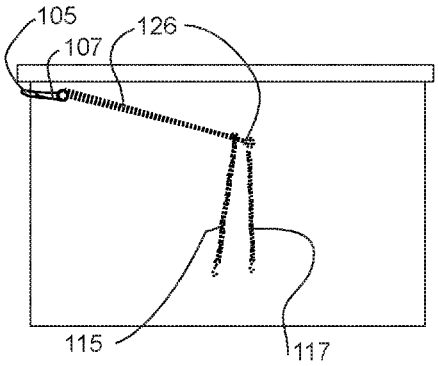
Fig. 30
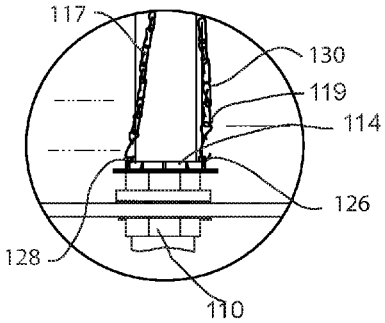
Fig. 31`
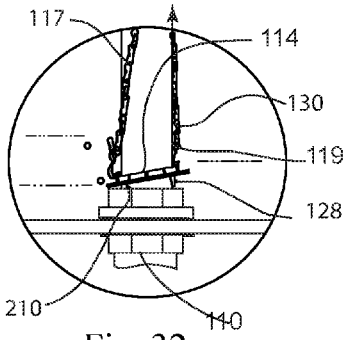
Fig. 32
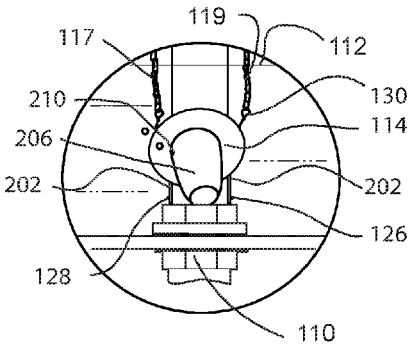
Fig. 33
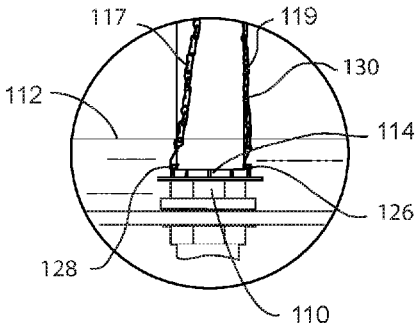
Fig. 34

DUAL FLUSH TOILET FLAPPER VALVE SYSTEM

CROSS-REFERENCE TO RELATED APPLICATIONS

This application claims the benefit of priority from Provisional Patent Application No. 62/089,201 filed on Dec. 8, 2014 and Provisional Patent Application No. 62/137,529 filed on Mar. 24, 2015, which are incorporated herein by reference in their entirety.

STATEMENT REGARDING FEDERALLY SPONSORED RESEARCH AND DEVELOPMENT

Not Applicable.

REFERENCE TO A MICROFICHE APPENDIX

Not Applicable.

BACKGROUND OF THE INVENTION

Field of the Invention

This invention relates to a toilet flush mechanism that provides a choice of the volume of water used for a flush of the toilet.

Description of Related Art

Toilet flush mechanisms that provide dual flushes are used to provide water savings for flushes that require a small volume of flush water to replace the toilet bowl water containing liquid waste, and providing a larger volume of water for flushes that contain solid waste.

SUMMARY OF THE INVENTION

The present invention provides a cost effective toilet flapper valve, and a flapper valve operating system, to provide a choice of the volume of water that flows from the toilet tank to be used for a flush. The system uses a flapper valve with a buoyancy chamber with a vent opening largely on one side of the valve centerline, and an operating system that lifts the flapper valve from the side with the vent, rather than on the centerline as typical flapper valves are configured. This provides a simple effective control of the volume of water used by varying the duration of the depression of the flush handle. A short duration lifting of the handle minimizes the air released through the vent from the flapper buoyancy chamber resulting in a long flush. A long duration (example say "save" and then release for a duration) releases more air from the flapper buoyancy chamber resulting in a shorter flush. An alternate configuration is to provide two flush handles that operate to lift either the side of the flapper valve with the vent, or the opposite side. Lifting the side with the vent tilts the vent upward, releasing the air in the flapper valve buoyancy chamber, resulting in a short duration flush if only that side is lifted for a long enough duration to vent the chamber, or if a float is used to increase the flush duration. Lifting that side for a short duration, or lifting the opposite side as is done on some embodiments of the present invention, tilts the vent opening downward, giving a minimal venting of the buoyancy chamber air. The resultant buoyancy of the flapper valve gives a full duration flush.

BRIEF DESCRIPTION OF THE SEVERAL VIEWS OF THE DRAWINGS

A more complete understanding of the present invention can be obtained by considering the detailed description in conjunction with the accompanying drawings, in which:

FIG. 29 is a cut-away view of the internal components of a toilet tank incorporating the present invention with dual flush control handles. A circle shows the portion of this view comprising FIGS. 30 through 38.

FIG. 30 is a front view of the toilet tank of FIG. 29. The internal components which connect the control handle to the flapper valve are shown in broken lines.

FIG. 31 is a partial internal view of a toilet tank with a dual flush control handles incorporating the present invention with the flapper valve in the closed position.

FIG. 32 is a partial internal view of a toilet tank with dual flush control handles incorporating the present invention with the flapper valve lifted by action of the full flush handle to a partially open position.

FIG. 33 is a partial internal view of a toilet tank with dual flush control handles incorporating the present invention with the flapper valve lifted by action of the full flush handle to the fully open position.

FIG. 34 is a partial internal view of a toilet tank with dual flush control handles incorporating the present invention with the flapper valve in the closed position after a full flush.

DETAILED DESCRIPTION OF THE INVENTION

The dual flush toilet flapper valve system uses a cost effective configuration of a buoyancy type flapper valve (114), and a simple operating system to provide the capability to choose the volume of water used to flush a common tank-type flush toilet.

Figure 19:
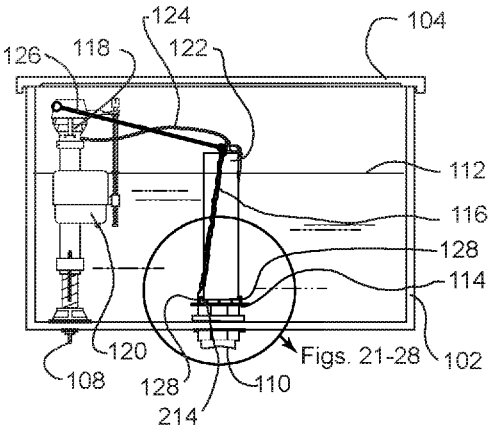
FIG. 19 is a cut-away view of the internal components of a toilet tank incorporating the present invention with a single flush control handle. A circle shows the portion of this view comprising FIGS. 21 through 28.
Figure 39:
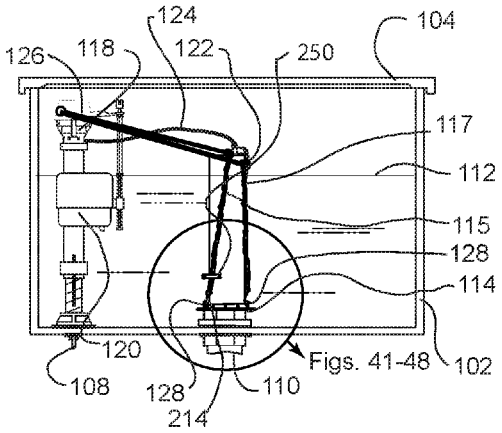
FIG. 39 is a cut-away view of the internal components of a toilet tank incorporating an embodiment of the present invention with dual flush control handles. A circle shows the portion of this view comprising FIGS. 41 through 48.

Various views of the flapper valve (114) are shown in FIGS. 1 through 18. The flapper valve typically is made of a flexible resilient polymer. It has a sealing surface (200), on the lower portion formed in a substantially flat annulus, surrounding a substantially round and hollow internal cavity buoyancy chamber (206) on the lower portion of the valve below the sealing surface. The sealing surface (200) and buoyancy chamber (206) are arranged to seal the outlet of the toilet tank water outlet (110) with the buoyancy chamber (206) located in the water outlet (110) when the valve is closed, as shown in FIGS. 19, 29 and 39. The chamber (206) drains of water and fills with air when the valve is closed.

Two flapper valve rotation arms (202) extend from the sealing surface area (200) toward the rotation arm end of the flapper valve, and terminate in a flapper axis pin opening (204) that is arranged to attach to the flapper valve axis pins (128) on the toilet tank overflow tube (122), also shown in FIGS. 19, 29 and 39. The centerline through these axis pin openings (204) form the flapper axis of rotation (216) which defines the arc in which the flapper valve moves from the closed to the open position.

Figure 1:
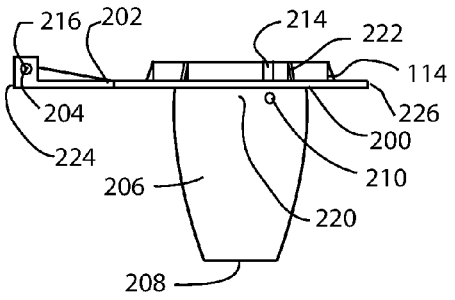
FIG. 1 is a right side view of a dual flush flapper valve.
Figure 2:
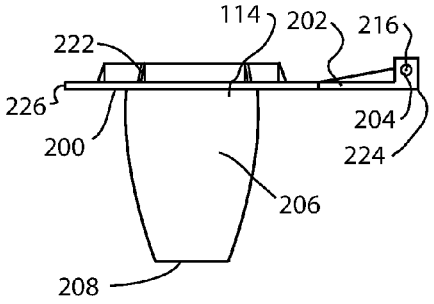
FIG. 2 is a left side view of a dual flush flapper valve.
Figure 3:
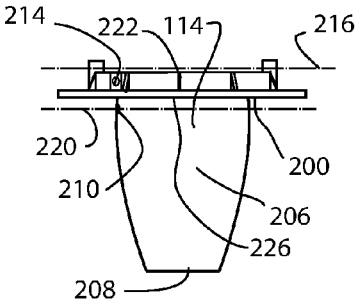
FIG. 3 is a front view of a dual flush flapper valve.
Figure 4:
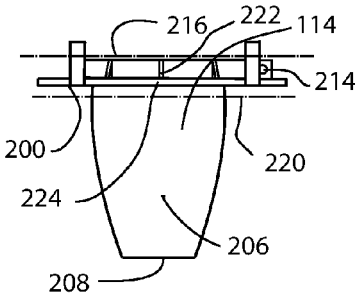
FIG. 4 is a back view of a dual flush flapper valve.
Figure 5:
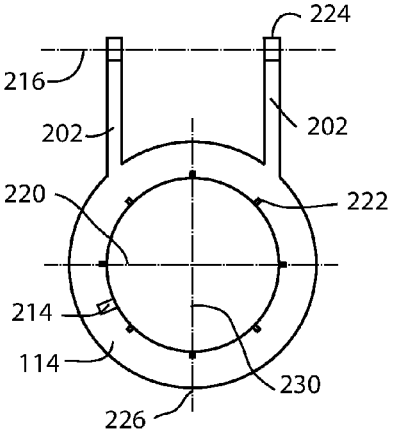
FIG. 5 is a top view of a dual flush flapper valve.
Figure 6:
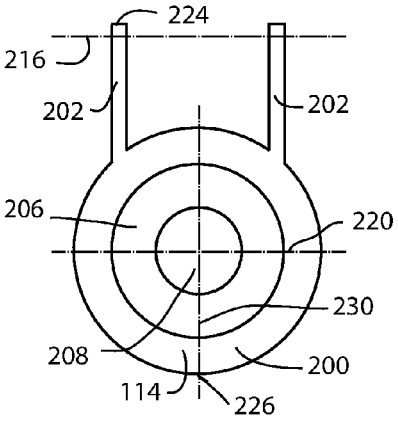
FIG. 6 is a bottom view of a dual flush flapper valve.
Figure 7:
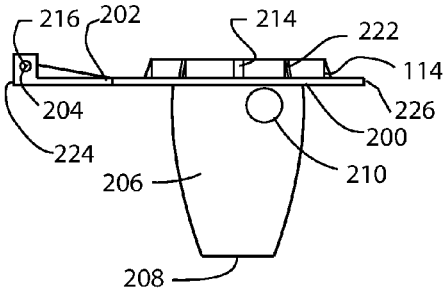
FIG. 7 is a left side view of an embodiment of a dual flush flapper valve.
Figure 8:
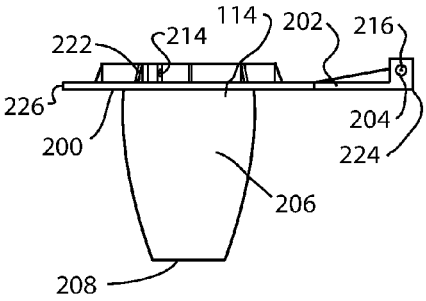
FIG. 8 is a right side view of an embodiment of a dual flush flapper valve.
Figure 9:
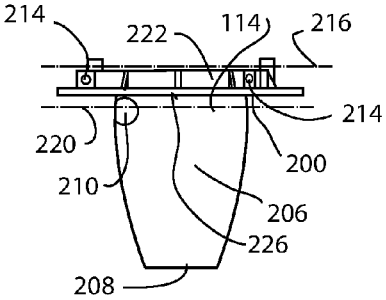
FIG. 9 is a front view of an embodiment of a dual flush flapper valve.
Figure 10:
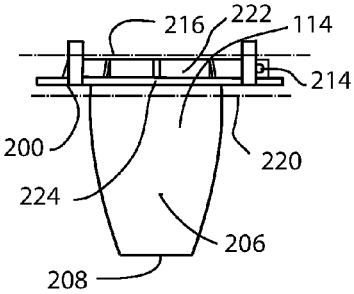
FIG. 10 is a back view of an embodiment of a dual flush flapper valve.
Figure 11:
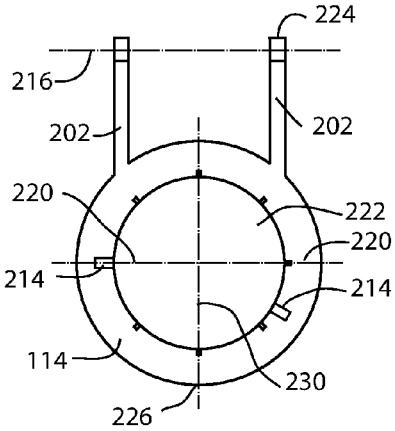
FIG. 11 is a top view of a an embodiment of a dual flush flapper valve.
Figure 12:
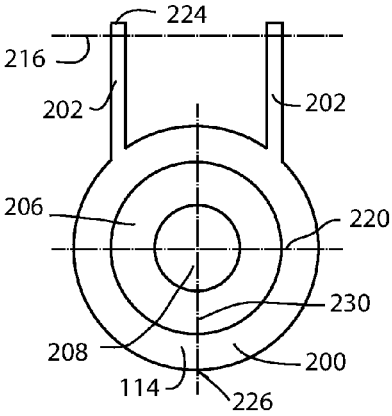
FIG. 12 is a bottom view of an embodiment of a dual flush flapper valve.
Figure 13:
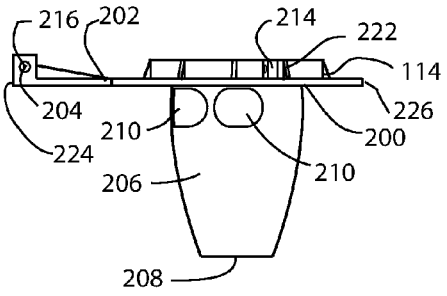
FIG. 13 is a left side view of another embodiment of a dual flush flapper valve.
Figure 14:
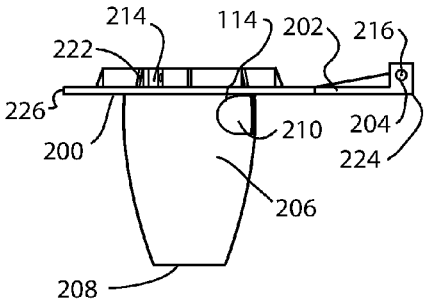
FIG. 14 is a right side view of another embodiment of a dual flush flapper valve.
Figure 15:
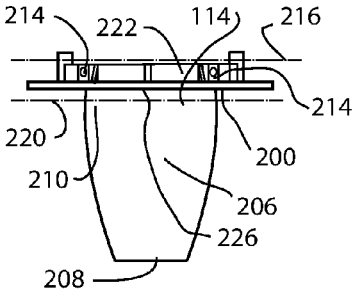
FIG. 15 is a front view of another embodiment of a dual flush flapper valve.
Figure 17:
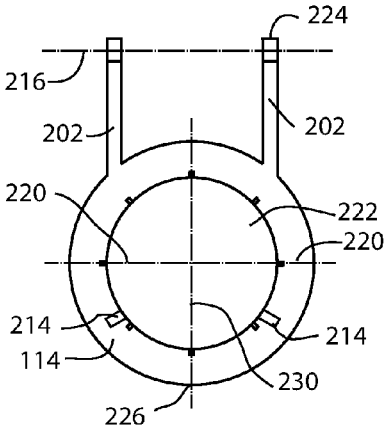
FIG. 17 is a top view of another embodiment of a dual flush flapper valve.
Figure 18:
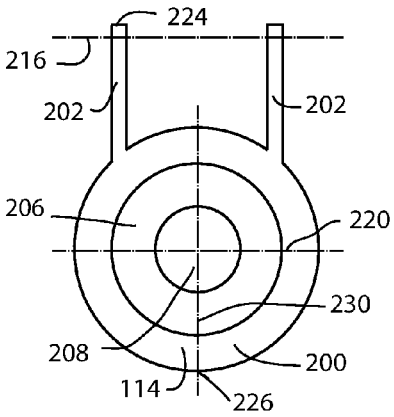
FIG. 18 is a bottom view of another embodiment of a dual flush flapper valve.

The flapper valve centerline (230) has a rotation arm end (224) and an opposing end, which is the high point end (226) of the flapper valve when in the open position. The flapper valve upper portion has one or more lift chain attachment openings (214) on one side or the other of a lift centerline (220). They may be on one or both sides of the flapper valve centerline (230), which is substantially in the center of the flapper between the two ends as shown in FIGS. 5, 6, 11, 12, 17, and 18. The lift chain attachment openings (214) are shown at locations on the lift centerline (220), which is parallel to the flapper axis of rotation (216), toward the periphery of the valve in FIG. 11, but may be located in a lift area within about 30 degrees off the centerline (220) as shown in FIGS. 5, 11, and 17, and still provide the desired one-sided lift. Either configuration may be used for any of the embodiments. The chain attachment opening (214) in one embodiment of the invention may attach the flapper lift chain (116) to only one opening as shown in FIG. 19 through 28. An alternative configuration is to utilize two flapper lift chains (116) as shown in FIGS. 29 and 39, one for a short duration flush and the other (130) for a full flush. The lift chains may be any means for exerting a lifting force on the flapper valve at the lift chain attachment opening location, example cord, polymer string, or solid rod. Locating the chain attachment openings to the side of the centerline preferentially lifts the side on which the chain is attached higher than the opposing side due to the flexibility of the valve material. The flapper valve upper portion also may have upper portion stiffening (222) arranged to assist in controlling deformation of the valve, which is made of a flexible polymer.

Typically the hollow internal cavity buoyancy chamber (206) is substantially round in shape, and its walls taper downward from the sealing surface (200) to a drain and air inlet (208) opening distal from the sealing surface (200). Those familiar with the art will recognize the taper of the buoyancy chamber (206) may vary with little effect on the operation of the valve as long as there is no physical interference with the water outlet (110) as the valve opens and closes following the flapper axis of rotation (216). The buoyancy chamber (206) has a vent opening (210) through the buoyancy chamber (206) side located high on the chamber near the transition from the buoyancy chamber side to the valve sealing surface. This provides a passage between the hollow internal cavity and the exterior through which air may vent. In one embodiment, this vent opening (210) is preferably located slightly offset (example V) from the flapper lift centerline (220) with the offset in the direction of the high point end (226), and on the side of the flapper valve with a short duration flush lift chain attachment as in FIG. 29 or 39, or for a single lift chain as in FIG. 19. If there are two lift chain attachments used, the vent opening (210) is located substantially on the side which initiates the short duration flush. With this configuration, in some embodiments the offset of the vent opening (210) from the flapper lift centerline (220) may be reduced or eliminated.

Figure 16:
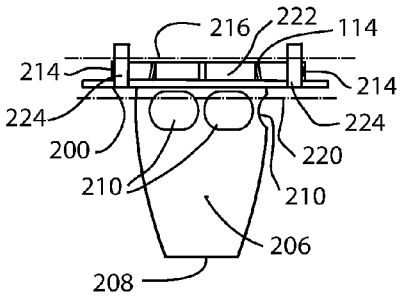
FIG. 16 is a back view of another embodiment of a dual flush flapper valve.

An alternate embodiment, shown in FIGS. 13 through 18, may include one or more buoyancy chamber (206) vent openings (210) largely on the side which initiates the short duration flush, and also on the side toward the rotation arm end (224). The openings facing the rotation arm end (224) may be on both sides of the flapper valve centerline (230) as shown in FIG. 16, although the greatest area of vent opening is predominantly on one side of the centerline known as the buoyancy chamber vent opening side. These openings facing the rotation arm end are at the low point of the buoyancy chamber when the flapper valve is fully open and therefore do not detract from the buoyancy of the valve when it is open. This vent capability provides a very quick venting of the buoyancy chamber (206) for a short duration flush while allowing sufficient air to remain in the buoyancy chamber (206) to provide a long duration flush. This embodiment is especially of interest with very large volume toilet water tanks.

An embodiment of the dual flush toilet flapper valve is used in conjunction with a flapper chain float (250) attached to the short flush lift chain (117) as shown in FIGS. 39-48. This may be used with any of the configurations and is a preferred configuration with the rapid venting short flush flapper embodiment in FIGS. 13 through 18. The flapper chain float size may be adjusted to obtain the desired duration of the short flush to accommodate differing sizes of toilet tanks.

Operation

The operating systems for the dual flush flapper valve system are shown in FIGS. 19, 29 and 39. The dual flush flapper valve system is located inside a toilet tank (102) which is covered by a lid (104), except for maintenance periods. The system has a water inlet (108) with the water flow turned on and off by a ballcock (118), which is controlled by a float ball (120) that floats on the water and moves in response to changes in the level (112) in the tank (102). The water level is maintained at a desired level by adding water through the ballcock (118) when the float moves below a predetermined desired water level (112). An overflow tube (122) is provided to limit the water level (112) should the float ball (120) and ballcock (118) fail to shut off the water flow at the desired level. This overflow tube also allows water flow during the flush from the ballcock (118) to the overflow (122) through the refill tube (124) to reestablish the water level in the toilet bowl. This system of toilet tank (102) water level maintenance is commonly used, as those familiar with the art will recognize.

Figure 20:
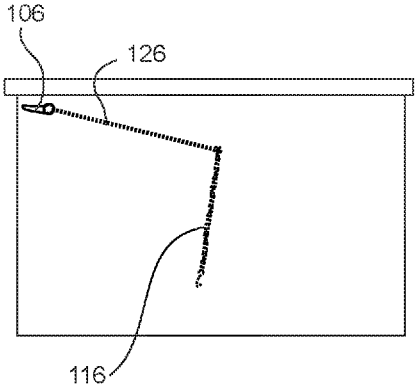
FIG. 20 is a front view of the toilet tank of FIG. 19. The internal components which connect the control handle to the flapper valve are shown in broken lines.
Figure 40:
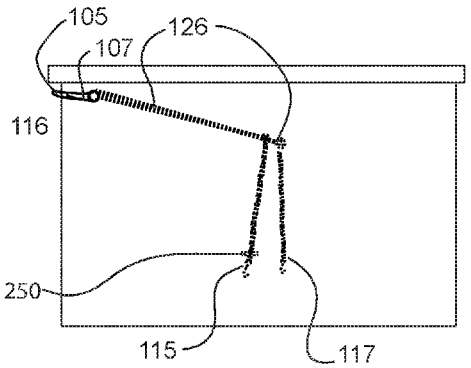
FIG. 40 is a front view of the toilet tank of FIG. 33. The internal components which connect the control handle to the flapper valve are shown in broken lines.

A flush of the toilet contents using the dual flush flapper valve system is initiated by a flush control handle (106) attached to a lift arm (126) connected to a flapper lift chain (116) that connects to the flapper valve lift chain attachment point (214) located as shown in FIG. 19 on a side of the flapper valve centerline (230), see FIGS. 5, 11 and 17, where the flapper buoyancy chamber vent opening (210) is located. See FIGS. 1, 7, and 13 for side views of this side. FIG. 20 shows the handle (106) and its relationship to the lift arm (126) and lift chain (116), which are in broken lines. If the system uses two flapper valve lift chains, as shown in FIGS. 29 and 39, there are two flush control handles, a short flush handle (107) located on the side of the flapper valve centerline (230) where the flapper buoyancy chamber vent opening (210) is located, and a second, long duration flush handle (105) located on the opposite side of the flapper valve centerline (230). These are operated separately and independently. The two flush control handles (105) and (107) operate separate shafts, connected to separate lift arms (126) and separate flapper lift chains (115) and (117) and are operated independently. The shafts operated by the flush control handles (105) and (107) may have a first shaft with a hollow center to allow the second shaft to operate inside the first shaft as is known to those familiar with the art. FIGS. 30 and 40 show the handles (105) and (107) and their relationship to the lift arms (126) and lift chains (115) and (117). These two handles each connect to a lift arm (126) connected to the respective flapper lift chains (115) and (117), one for short duration flushes (117), and the other one for longer duration flushes (115).

Figure 21:
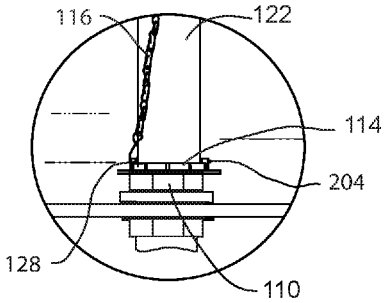
FIG. 21 is a partial internal view of a toilet tank with a single flush control handle incorporating the present invention with the flapper valve in the closed position.

FIGS. 19 through 28 illustrate the operation of the dual flush flapper valve system with control by a single flush control handle (106), lift arm (126) and lift chain (116) as shown in FIGS. 19 and 20. FIG. 21 shows the flapper valve seated on the water outlet (110) which prevents water in the tank from draining through the water outlet (110) unless the water is draining through the overflow tube (122) due to a malfunction causing a high water level.

Figure 22:
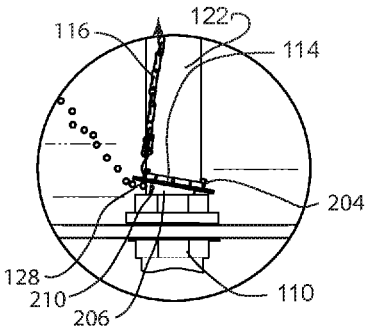
FIG. 22 is a partial internal view of a toilet tank with a single flush control handle incorporating the present invention with the flapper valve in a partially open position exhausting a portion of the buoyancy air.
Figure 23:
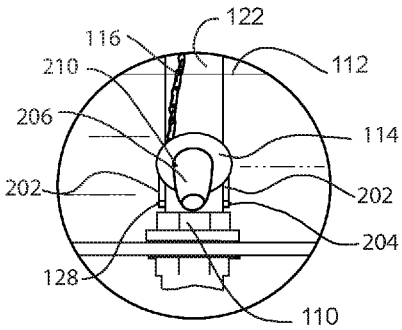
FIG. 23 is a partial internal view of a toilet tank with a single flush control handle incorporating the present invention with the flapper valve retaining buoyancy in the fully open position for a full flush.
Figure 24:
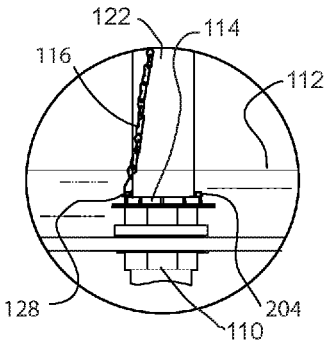
FIG. 24 is a partial internal view of a toilet tank with a single flush control handle incorporating the present invention with the flapper valve in the closed position after a full flush.
Figure 25:
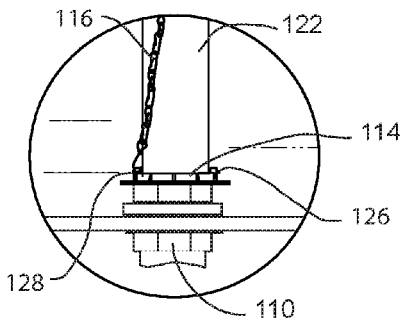
FIG. 25 is a partial internal view of a toilet tank with a single flush control handle incorporating the present invention with the flapper valve in the closed position.
Figure 26:
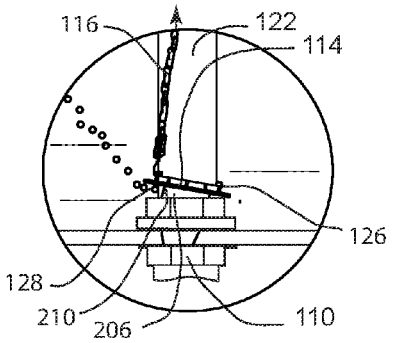
FIG. 26 is a partial internal view of a toilet tank with a single flush control handle incorporating the present invention with the flapper valve tilted in a partially open position to exhaust buoyancy air for a partial flush.

When desirable to initiate a long duration flush from the closed flapper valve position shown in FIG. 21, the flush control handle (106) is used to apply force on the flapper valve to open it for a very short duration and released. The duration is preferably just the duration to move the flapper valve to the full open position. This handle movement causes the lift chain (116) to preferentially lift the side of the flapper valve, as indicated by the arrow in FIG. 22, with the buoyancy chamber vent opening (210). The flexibility of the flapper valve tilts this side upward while the opposite side is tilted down. This position of the flapper allows some air release from the buoyancy chamber (206) as the flapper valve (114) is moving open, as shown in FIG. 22. Lifting of the flapper valve (114) allows water flow through the water outlet (110) opening to the toilet that had been sealed by the flapper valve (114). This initiates the toilet flush. The release of air from the flapper valve buoyancy chamber (206) only lasts for the duration while the valve rotates to the full open position, shown in FIG. 23, at which point the lift chain tension force is released. This allows the flapper valve (114) to assume a level full open position as shown. This is due to the buoyancy chamber (206) only partially filling with water entering due to the short duration of tension on the lift chain allowing venting for only a short duration. This leaves sufficient air in the chamber to maintain the flapper valve (114) in a level full open position, assuming the actuation of the flush control handle (106) in moving the flapper valve (114) to this position was sufficiently brief. This allows water to continue to pass through the water outlet (110) which continues to flush the toilet, even though the lift chain (116) no longer is exerting force to open the flapper valve (114). Once the water level (112) drops such that the flapper valve buoyancy can no longer support the flapper valve (114), the flapper valve will rotate closed to the position as shown in FIG. 24, driven by gravity on the weight of the flapper valve. This provides a flush that provides the entire designed water capacity of the toilet tank (102).

Figure 27:
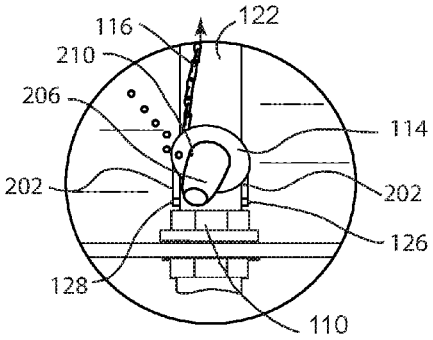
FIG. 27 is a partial internal view of a toilet tank with a single flush control handle incorporating the present invention with the flapper valve in the fully open position having exhausted the buoyancy air for a partial flush.
Figure 28:
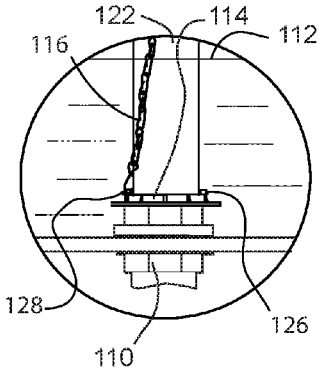
FIG. 28 is a partial internal view of a toilet tank with a single flush control handle incorporating the present invention with the flapper valve in the closed position after a partial flush.

When desirable to initiate a short duration flush, with the flapper valve (114) sealing the water outlet (110) as shown in FIG. 24, the flush control handle (106) is depressed so as to apply force on the flapper valve to open it for a longer duration and then released. One method of timing this longer duration is to say slowly "Save." This causes the lift chain (116) to preferentially lift the side of the flapper valve, as indicated by the arrow in FIG. 26, with the buoyancy chamber vent opening (210). This allows air release from the buoyancy chamber (206) as the flapper valve (114) is moving open, as shown in FIG. 27. With the flush control handle (106) continued to be depressed while the flapper valve (114) is open, as indicated by the arrow in FIG. 27 it continues to tilt the flapper valve (114) as shown. This allows a longer duration of the venting of air from the flapper valve buoyancy chamber (206), as also shown in the figure. This additional venting removes sufficient air from the buoyancy chamber (206) such that when the flush control handle is released the flapper valve (114) no longer has buoyancy and rotates closed to the position shown in FIG. 28, driven by gravity on the weight of the flapper valve, even though there is sufficient water in the tank, as shown by the water level (112) in the figure, to maintain the valve open if it had sufficient air in the buoyancy chamber (206). This provides a short flush, draining less than the designed water capacity from the toilet tank (102).

FIGS. 29 through 38 illustrate the operation of the dual flush flapper valve system with control by dual flush control handles (105) and (107), lift arms (126) and lift chains (115) and (117) as shown in FIGS. 29 and 30. FIG. 31 shows the flapper valve seated on the water outlet (110) which prevents water in the tank from draining through the water outlet (110).

When desirable to initiate a long duration flush from the closed flapper valve position shown in FIG. 31, the long flush control handle (105) is used to apply force to the flapper valve to open it. This causes the lift chain (115) to lift the side of the flapper valve, as indicated by the arrow in FIG. 32, opposite the buoyancy chamber vent opening (210). The flexibility of the flapper valve tilts this side upward while the opposite side is tilted down. This lifts the flapper valve to the full open position, as shown in FIG. 33, with minimal venting of air from the flapper valve buoyancy chamber (206) as illustrated by the small amount of air bubbles in FIGS. 32 and 33. The flapper valve will have sufficient air in the buoyancy chamber (206), to maintain the flapper valve (114) in the full open position while the water surrounds it. This allows water to continue to pass through the water outlet (110) and continue to flush the toilet, even though the lift chain (115) no longer is exerting force to open the flapper valve (114). Once the water level (112) drops such that the water can no longer support the flapper valve (114) by the air in the buoyancy chamber (206), as shown in FIG. 34 the flapper valve will rotate closed to the position shown in the figure, driven by the weight of the flapper valve. This provides a flush that provides the entire designed water capacity of the toilet tank (102).

Figure 35:
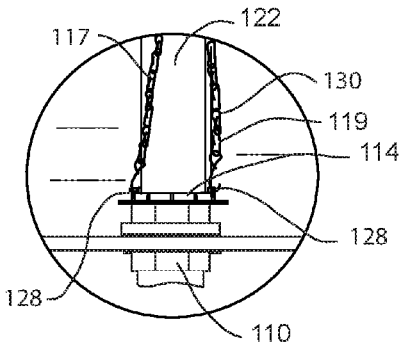
FIG. 35 is a partial internal view of a toilet tank with dual flush control handles incorporating the present invention with the flapper valve in the closed position.
Figure 36:
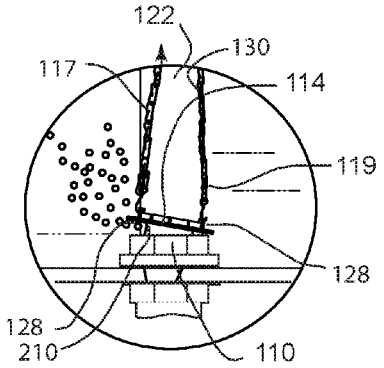
FIG. 36 is a partial internal view of a toilet tank with dual flush control handles incorporating the present invention with the flapper valve lifted by the partial flush handle to a partially open position.
Figure 37:
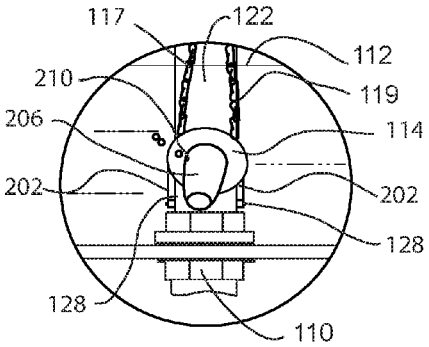
FIG. 37 is a partial internal view of a toilet tank with dual flush control handles incorporating the present invention with the flapper valve lifted by the partial flush handle to the fully open position.
Figure 38:
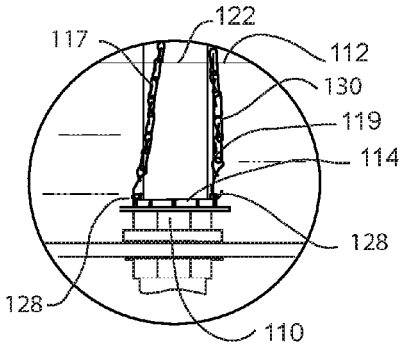
FIG. 38 is a partial internal view of a toilet tank with dual flush control handles incorporating the present invention with the flapper valve in the closed position after a partial flush.

When desirable to initiate a short duration flush from the closed position shown in FIG. 35, the partial flush control handle (107) is used to apply force to the flapper valve to open it. This causes the lift chain (117) to lift the side of the flapper valve, as indicated by the arrow in FIG. 36, containing the buoyancy chamber vent opening (210). The flexibility of the flapper valve tilts this side upward while the opposite side is tilted down. This allows substantial air release from the buoyancy chamber (206) as the flapper valve (114) is moving open, as shown in FIG. 36. With this substantial air release, the buoyancy chamber (206) provides insufficient buoyancy when the flapper valve is in the full open position shown in FIG. 37, such that the flapper valve (114) rotates closed to the position shown in FIG. 38, driven by the weight of the flapper valve, even though there is sufficient water in the tank, as shown by the water level (112) in the figure, to maintain the valve open if it had sufficient air in the buoyancy chamber (206). This provides a short flush, draining less than the designed water capacity from the toilet tank (102) as shown by the water level (112).

FIGS. 39 through 48 illustrate the operation of an embodiment of the dual flush flapper valve system with a long flush flapper lift chain attachment opening (214) located offset from the flapper lift centerline (220) and with control by dual flush control handles (105) and (107), lift arms (126) and lift chains (115) and (117) as shown in FIGS. 39 and 40. The short flush lift chain in this embodiment has a flapper lift chain float (250).

Figure 41:
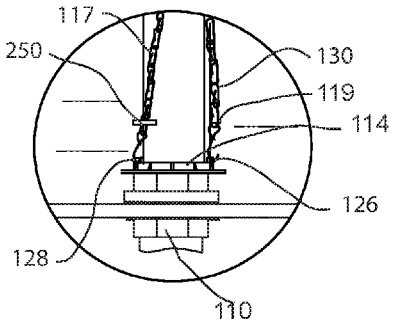
FIG. 41 is a partial internal view of a toilet tank with a dual flush control handles incorporating an embodiment of the present invention with the flapper valve in the closed position.
Figure 42:
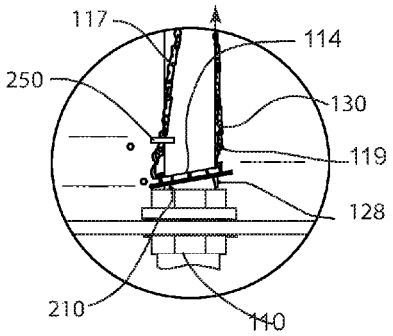
FIG. 42 is a partial internal view of a toilet tank with dual flush control handles incorporating an embodiment of the present invention with the flapper valve lifted by action of the full flush handle to a partially open position.
Figure 43:
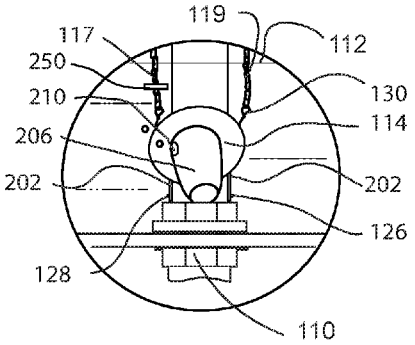
FIG. 43 is a partial internal view of a toilet tank with dual flush control handles incorporating an embodiment of the present invention with the flapper valve lifted by action of the full flush handle to the fully open position.
Figure 44:
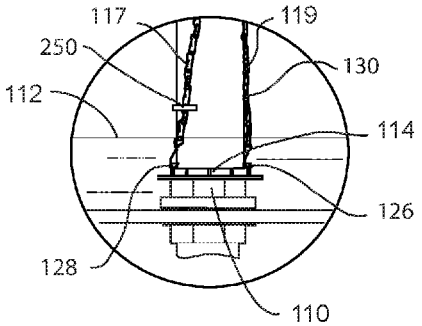
FIG. 44 is a partial internal view of a toilet tank with dual flush control handles incorporating an embodiment of the present invention with the flapper valve in the closed position after a full flush.

When desirable to initiate a long duration flush from the closed position shown in FIG. 41, the long flush control handle (105) is used to apply force to the flapper valve to open it. This causes the lift chain (115) to lift the side of the flapper valve, as indicated by the arrow in FIG. 42, opposite the buoyancy chamber vent opening (210). The flexibility of the flapper valve tilts this side upward while the opposite side is tilted down. This lifts the flapper valve to the full open position, as shown in FIG. 43, with minimal venting of air from the flapper valve buoyancy chamber (206) as illustrated by the small amount of air bubbles in FIGS. 42 and 43. The flapper valve will have sufficient air in the buoyancy chamber (206), to maintain the flapper valve (114) in the full open position while the water surrounds it. This allows water to continue to pass through the water outlet (110) and continue to flush the toilet, even though the lift chain (115) no longer is exerting force to open the flapper valve (114). Once the water level (112) drops such that the water is no longer supporting the flapper valve (114) by the air in the buoyancy chamber (206), as shown in FIG. 44, the flapper valve will rotate closed to the position shown in the figure, driven by the weight of the flapper valve. This provides a flush that provides the entire designed water capacity of the toilet tank (102).

Figure 45:
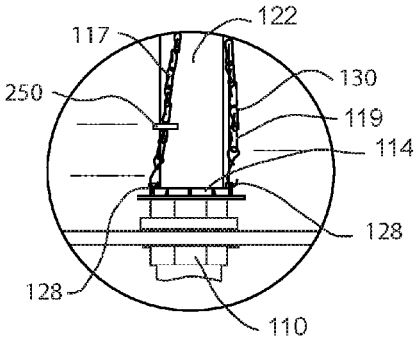
FIG. 45 is a partial internal view of a toilet tank with dual flush control handles incorporating an embodiment of the present invention with the flapper valve in the closed position.
Figure 46:
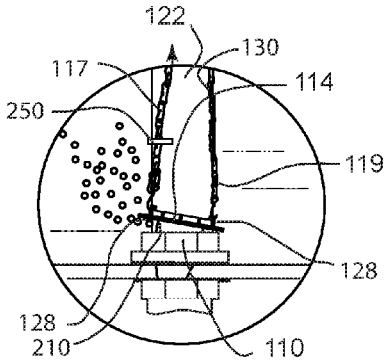
FIG. 46 is a partial internal view of a toilet tank with dual flush control handles incorporating an embodiment of the present invention with the flapper valve lifted by the partial flush handle to a partially open position.
Figure 47:
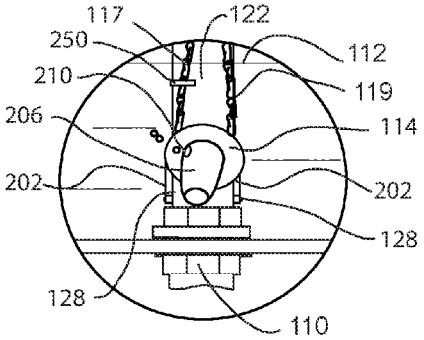
FIG. 47 is a partial internal view of a toilet tank with dual flush control handles incorporating an embodiment of the present invention with the flapper valve lifted by the partial flush handle to the fully open position.
Figure 48:
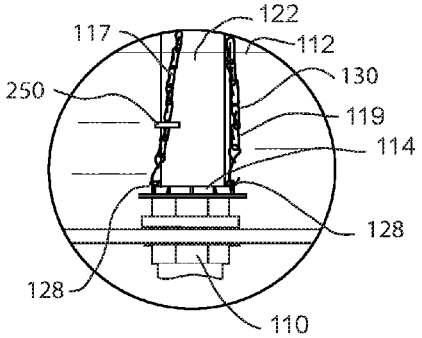
FIG. 48 is a partial internal view of a toilet tank with dual flush control handles incorporating an embodiment of the present invention with the flapper valve in the closed position after a partial flush.

When desirable to initiate a short duration flush from the closed position shown in FIG. 45, the partial flush control handle (107) is used to apply force to the flapper valve to open it. This causes the lift chain (117) to lift the side of the flapper valve, as indicated by the arrow in FIG. 46, containing the buoyancy chamber vent opening (210). The flexibility of the flapper valve tilts this side upward while the opposite side is tilted down. This allows substantial air release from the buoyancy chamber (206) as the flapper valve (114) is moving open, as shown in FIG. 46. With this substantial air release, the buoyancy chamber (206) provides insufficient buoyancy when the flapper valve is in the full open position shown in FIG. 47, such that the flapper valve (114) rotates closed to the position shown in FIG. 48. The lift chain float (250) attached to the short flush lift chain (117) provides a desired delay in this rotation of the flapper valve (114) to the closed position to allow the desired flow volume for the short flush. It may be desirable to adjust this float's sizing to accommodate different sizes of toilet tanks (102) as smaller tanks may require a longer duration flush to provide an adequate volume of water for the short duration flush.

Figure 49:
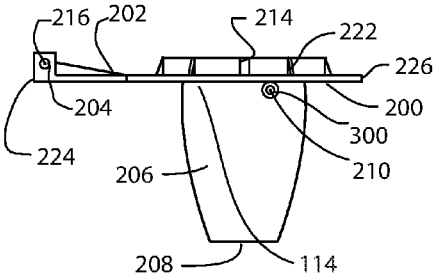
FIG. 49 is a right side view of a dual flush flapper valve incorporating a vent opening orifice.
Figure 50:
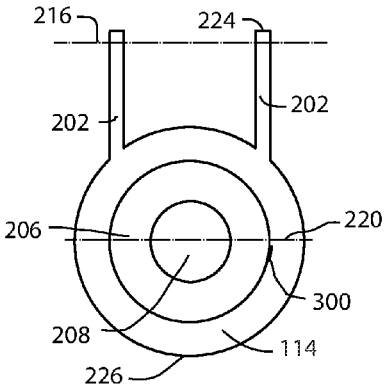
FIG. 50 is a bottom view of a dual flush flapper valve incorporating a vent opening orifice.
Figure 51:
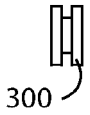
FIG. 51 is a side view of a dual flush flapper valve vent opening orifice.

The sizing of the buoyancy chamber vent opening (210) affects the venting rate from the buoyancy chamber (206), and therefore provides another means of controlling the volume of water used in a short duration flush. One means of providing an adjustable flush duration is an orifice (212) fitted to the buoyancy chamber vent opening (210) as shown in FIGS. 49 through 51. A selection of orifices (212) with various vent opening sizes will provide the capability to optimize the dual flush toilet flapper valve system performance for a wide range of toilet sizes.

Figure 52:
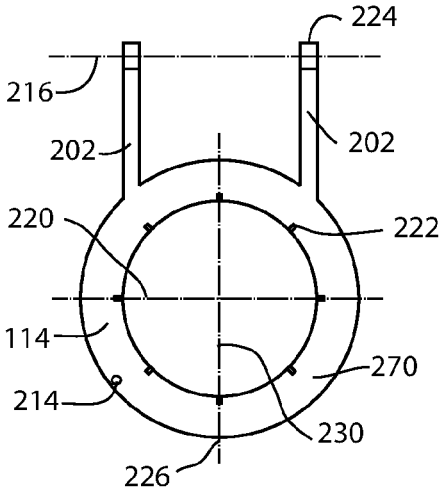
FIG. 52 is a top view of another embodiment of a dual flush flapper valve.
Figure 53:
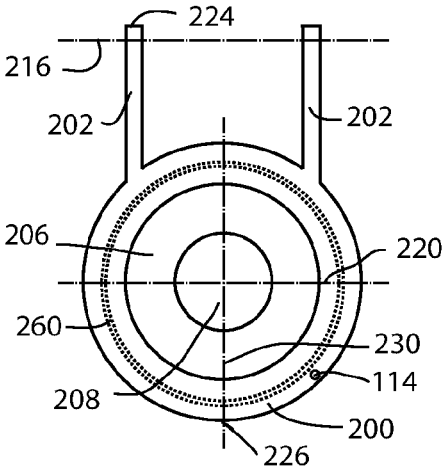
FIG. 53 is a bottom view of another embodiment of a dual flush flapper valve.

An alternative configuration of a lift chain attachment opening (214) is shown in FIGS. 52 and 53. This configuration provides the opening between the flapper valve (114) upper surface (270) and the sealing surface (200). The opening is located toward the periphery of the flapper valve outside the portion of the sealing surface contact location (260) with the toilet water outlet (110). This configuration may be used in any of the flapper valve embodiments.

Those familiar with the art will recognize that the embodiments described have other possible variations. These descriptions of the invention provided are not intended to limit the invention.

I claim:

1. A dual flush volume tank-type toilet flush mechanism comprising:

a toilet tank containing the water used to flush the toilet;

a toilet flapper valve arranged with an upper portion with one or more chain attachment openings and a lower portion with a sealing surface arranged to seal a toilet tank water outlet with the flapper valve in a closed position the flapper further arranged with a buoyancy chamber arranged below the sealing surface that contains air that supports the flapper valve when in an open position and submerged in the toilet tank water;

the flapper valve further arranged with a flapper rotation arm end on one side of the sealing surface with one or more flexible rotation arms arranged to attach to a flapper valve axis pin to form the flapper axis of rotation, and a flapper high point end on an opposing side of the sealing surface arranged to move about the axis of rotation to open the valve and allow water flow through the toilet tank water outlet:

a flapper valve centerline arranged normal to the axis of rotation with a flapper lift centerline substantially normal to the centerline, the chain attachment openings arranged near the periphery of the valve near the flapper lift centerline providing a location off the centerline to lift and open the valve; and the buoyancy chamber arranged with one or more vent openings substantially on one side of the flapper valve centerline and located on the side of the flapper centerline where a lift chain is attached to the chain attachment opening whereby the volume of water used to flush the toilet is chosen by varying the duration of lift applied to the flapper valve by the lift chain which raises the side of the flapper valve containing the vent openings, which varies the duration of venting air from the flush valve buoyancy chamber through the vent opening.

2. The flush mechanism of claim 1 further comprising providing a second lift chain on the opposing side from the first lift chain whereby the second lift chain provides a long duration flush and the first lift chain a short duration flush.

3. The flush mechanism of claim 2 further comprising a removable orifice installed in the buoyancy chamber vent opening arranged to adjust the venting of the buoyancy chamber thereby adjusting the flush duration when the short flush lift chain opens the flapper valve.

4. The flush mechanism of claim 2 further comprising a lift chain float attached to the short flush lift chain arranged to adjust the duration the flapper valve is open thereby adjusting the flush duration.

5. A method of providing a choice of a tank-type toilet water flush volume comprising:

providing a flapper valve arranged to move on an axis of rotation between an open and a closed position on a toilet tank water outlet thereby retaining and releasing the water in the tank;

arranging the flapper valve with a buoyancy chamber arranged to fill with air in the closed position and provide buoyancy of the valve in the tank water in an open position;

installing a first lift chain attachment opening on one side of a centerline perpendicular to the axis of rotation of the flapper valve creating a vent opening through the wall of the buoyancy chamber at a location on the first lift chain attachment opening side of the flapper valve centerline;

attaching a lift chain to the first lift chain attachment opening whereby with no force on the lift chain, the flapper valve is in a closed position and seals the tank water in the tank;

applying a force to the lift chain to open the flapper valve wherein the vent opening releases air when the force is applied to the lift chain; and varying the duration of the force to the lift chain, whereby a long duration lift provides a short flush as the venting of the buoyancy chamber is sufficient to lose the flapper valve buoyancy thereby permitting it to close upon release of the force, and whereby a short duration lift provides a long flush as the venting of the buoyancy chamber is insufficient to lose the flapper valve buoyancy thereby permitting it to stay open upon release of the force.

6. The method of claim 5 wherein providing a second lift chain attachment opening on the side of the flapper valve centerline opposite the first lift chain whereby lifting the flapper valve by the second lift chain provides a long flush.

7. The method of claim 6 wherein providing a removable orifice in the buoyancy chamber vent opening adjusts the venting rate of the buoyancy chamber thereby adjusting the flush duration.

8. The method of claim 6 wherein providing a lift chain float attached to the lift chain attached to the first lift chain attachment opening adjusts the duration the flapper valve is open thereby adjusting the flush duration.

9. A tank-type toilet flapper valve comprising:

a sealing surface arranged to close a tank water outlet thereby retaining the water in the tank;

two flexible rotation arms arranged on one side of the valve forming an axis of rotation that defines the arc the valve can travel in moving from a closed position sealing the water outlet and an open position permitting flow through the water outlet;

a valve centerline defining two portions of the valve perpendicular to the axis of rotation;

the valve further arranged with a buoyancy chamber arranged to fill with air within the tank water outlet with the valve in the closed position, the buoyancy chamber arranged to support the flapper valve by air buoyancy in the tank water when the flapper valve is in an open position;

one or more vent openings in the buoyancy chamber arranged on one side of the valve centerline to allow air venting;

a lift chain attachment opening arranged on the side of the valve centerline with the vent opening; and whereby applying a lifting force by the lift chain attachment opening moves the flapper valve from the closed position and allows venting of air from the buoyancy chamber, a short duration application of lifting force provides a small amount of venting providing a long flush duration, a longer duration of application of lifting force provides a larger amount of venting providing a short flush duration.

10. The flapper valve of claim 9 wherein a second lift chain attachment opening is arranged on the side of the valve centerline opposite the vent opening.

11. The flapper valve of claim 9 wherein one or more vent openings are provided in the buoyancy chamber arranged on the rotation arm side of the valve.

12. The flapper valve of claim 10 wherein a removable orifice in the buoyancy chamber vent opening adjusts the venting rate of the buoyancy chamber thereby adjusting the flush duration.

13. The flapper valve of claim 11 wherein a removable orifice in the buoyancy chamber vent opening adjusts the venting rate of the buoyancy chamber thereby adjusting the flush duration.

14. The flapper valve of claim 10 wherein a lift chain float attached to the lift chain attached to the first lift chain attachment opening adjusts the duration the flapper valve is open thereby adjusting the flush duration.

15. The flapper valve of claim 11 wherein a lift chain float attached to the lift chain attached to the first lift chain attachment opening adjusts the duration the flapper valve is open thereby adjusting the flush duration.

* * * * *